US010563442B2

(12) United States Patent
Pelekanos

(10) Patent No.: US 10,563,442 B2
(45) Date of Patent: Feb. 18, 2020

(54) PIVOT BLOCK

(71) Applicant: Allegion (Australia) Pty Ltd., Sunshine, VIC (AU)

(72) Inventor: Stylianos Pelekanos, Sydney (AU)

(73) Assignee: Allegion (Australia) Pty Ltd., Sunshine, VIC (AU)

( * ) Notice: Subject to any disclaimer, the term of this patent is extended or adjusted under 35 U.S.C. 154(b) by 0 days.

(21) Appl. No.: 15/513,099

(22) PCT Filed: Sep. 22, 2015

(86) PCT No.: PCT/IB2015/057278
§ 371 (c)(1),
(2) Date: Mar. 21, 2017

(87) PCT Pub. No.: WO2016/046733
PCT Pub. Date: Mar. 31, 2016

(65) Prior Publication Data

US 2017/0247921 A1 Aug. 31, 2017

(30) Foreign Application Priority Data

Sep. 22, 2014 (AU) ..... 2014903783

(51) Int. Cl.
*E05D 15/26* (2006.01)
*E06B 3/46* (2006.01)
*E06B 3/50* (2006.01)

(52) U.S. Cl.
CPC ..... *E05D 15/26* (2013.01); *E06B 3/5072* (2013.01); *E05Y 2201/11* (2013.01); *E05Y 2201/684* (2013.01); *E05Y 2201/708* (2013.01); *E05Y 2600/12* (2013.01); *E05Y 2600/456* (2013.01); *E05Y 2600/626* (2013.01)

(58) Field of Classification Search
CPC . E05D 15/0647; E05D 15/0682; E05D 15/26; E05D 15/06; E05D 15/08; E06B 3/46; E06B 3/5072; Y10T 16/354
USPC ..... 16/93 R; 160/345, 330; 248/265
See application file for complete search history.

(56) References Cited

U.S. PATENT DOCUMENTS 3,148,405 A * 9/1964 Dickinson ..... E05D 15/0634 16/105
4,852,628 A * 8/1989 Klein ..... E05D 15/26 160/118

(Continued)

FOREIGN PATENT DOCUMENTS

AU 2013202862 B1 * 2/2014
AU 2013202862 B1 2/2014
WO 2011/011832 A1 2/2011

OTHER PUBLICATIONS

International Search Report corresponding to PCT/IB2015/057278 dated Sep. 22, 2015, three pages.

*Primary Examiner* — Emily M Morgan
(74) *Attorney, Agent, or Firm* — Kilpatrick Townsend & Stockton LLP

(57) ABSTRACT

A pivot block including a first part for holding a bolt of an associated folding panel, and a second part that is able to be fixed to a track so as to position the first part and the bolt at a location whereby the folding panel is able to pivot about pivot bolt, wherein the first part is moveable relative to the second part lengthwise of the track, for adjustment of the position of the pivot bolt.

11 Claims, 5 Drawing Sheets

(56) References Cited

U.S. PATENT DOCUMENTS

| | | | | |
|---|---|---|---|---|
| 4,999,876 | A * | 3/1991 | Nass | E05D 7/04 16/236 |
| 6,192,962 | B1 * | 2/2001 | Glover | A47H 2/02 160/126 |
| 6,434,877 | B1 * | 8/2002 | Shelton | A01M 31/025 135/90 |
| 8,708,026 | B2 * | 4/2014 | Graves | A47H 1/022 160/330 |
| 2008/0092464 | A1 * | 4/2008 | Haab | E06B 3/5436 52/204.7 |
| 2009/0289463 | A1 * | 11/2009 | Tsai | E05D 15/26 292/341.15 |
| 2013/0037504 | A1 * | 2/2013 | Graves | H47H 1/022 211/124 |
| 2013/0097807 | A1 * | 4/2013 | Pelekanos | E05D 15/0656 16/86.2 |

* cited by examiner

A-A (1:1)

PIVOT BLOCK

RELATED APPLICATION

This application claims priority from Australian Patent Application Number AU2014903783, the contents of which are incorporated by reference.

FIELD OF THE INVENTION

The present invention relates to a pivot block for a folding panel.

BACKGROUND OF THE INVENTION

It is known to support a hanger bolt of a folding panel in an overhead track using a pivot block, which is installed in the track and fixed in place with a clamp or screw. The location of the block in the track may need to be adjusted so that the bolt is properly aligned and positioned for operation of the folding panel. This adjustment can be achieved manually by releasing and then sliding the block along the track. Once in the preferred location, the block is again fixed in position by either bolting or screwing the block in place.

OBJECT OF THE INVENTION

The present invention seeks to provide a pivot block with an alternative means of adjustment.

SUMMARY OF THE INVENTION

In accordance with the present invention, there is provided a pivot block including a first part for holding a pivot bolt of an associated folding panel, and a second part that is able to be fixed to a track so as to position the first part and the pivot bolt at a location whereby the folding panel is able to pivot about the pivot bolt, wherein the first part is moveable relative to the second part lengthwise of the track, for adjustment of the position of the pivot bolt.

Preferably, the first and second parts are connected for telescopic movement.

Preferably, the pivot block includes a fastener to secure the first and second parts together.

Preferably, the pivot block includes a cam mechanism that operates between the first and second parts to drive the lengthwise movement of the first part relative to the second part.

Preferably, the mechanism includes a cam mounted to one of the parts and a follower provided in the other part.

Preferably, the cam has a shaft that can be accessed through a base of one of the parts and an eccentric boss associated with the shaft that drives the follower when the shaft is rotated.

Preferably, the follower is in the form of a lateral groove in the other one of the parts.

Preferably, one of the parts has a slide that moves in and out of a channel formed in the other one of the parts when the parts are moved telescopically under action of the cam mechanism.

Preferably, the fastener passes through the slide and into a lock nut that clamps against the slide and fixes the parts together.

Preferably, the pivot block includes one or more connectors that pass through the second part to lock the pivot block to the track.

Preferably, the first part includes a threaded passage for screw-threaded engagement of the bolt and a lock assembly to secure the bolt against rotation and height adjustment.

Preferably, the lock assembly includes a collar that registers with flats of the bolt and a keeper for selectively holding the collar against rotation.

Preferably, the keeper is biased into engagement with the collar.

Preferably, the keeper includes a push button actuator that allows the keeper to be moved against the bias and out of engagement with the collar, to thereby accommodate rotation of the bolt for height adjustment.

Preferably, the first part has a base, recessed to house the keeper and the collar, and a cover plate fitted over the base, wherein the cover plater includes openings for the push button and for receipt of the bolt.

Preferably, a cover plate is also fitted over the base of the second part, with apertures to provide access to the cam mechanism and fastener.

In another aspect, the pivot block, as described above, is provided in combination with dress plate. The pivot block is configured to carry a bolt and be mounted in a track. The dress plate is adapted to be fitted onto the track after the pivot block is fixed in position and the first part adjusted relative to the second part. The dress plate serves to hide the pivot block from view and includes an elongate slot to accommodate various positions of the bolt, resulting from adjustment of the first part.

In another aspect, there is provided a pivot block, as described above, in combination with a bolt mounted in the first part of the pivot block.

BRIEF DESCRIPTION OF THE DRAWINGS

The invention is described by way of non-limiting example only with reference to the accompanying drawings, in which.

DETAILED DESCRIPTION OF THE INVENTION

Figure 1:
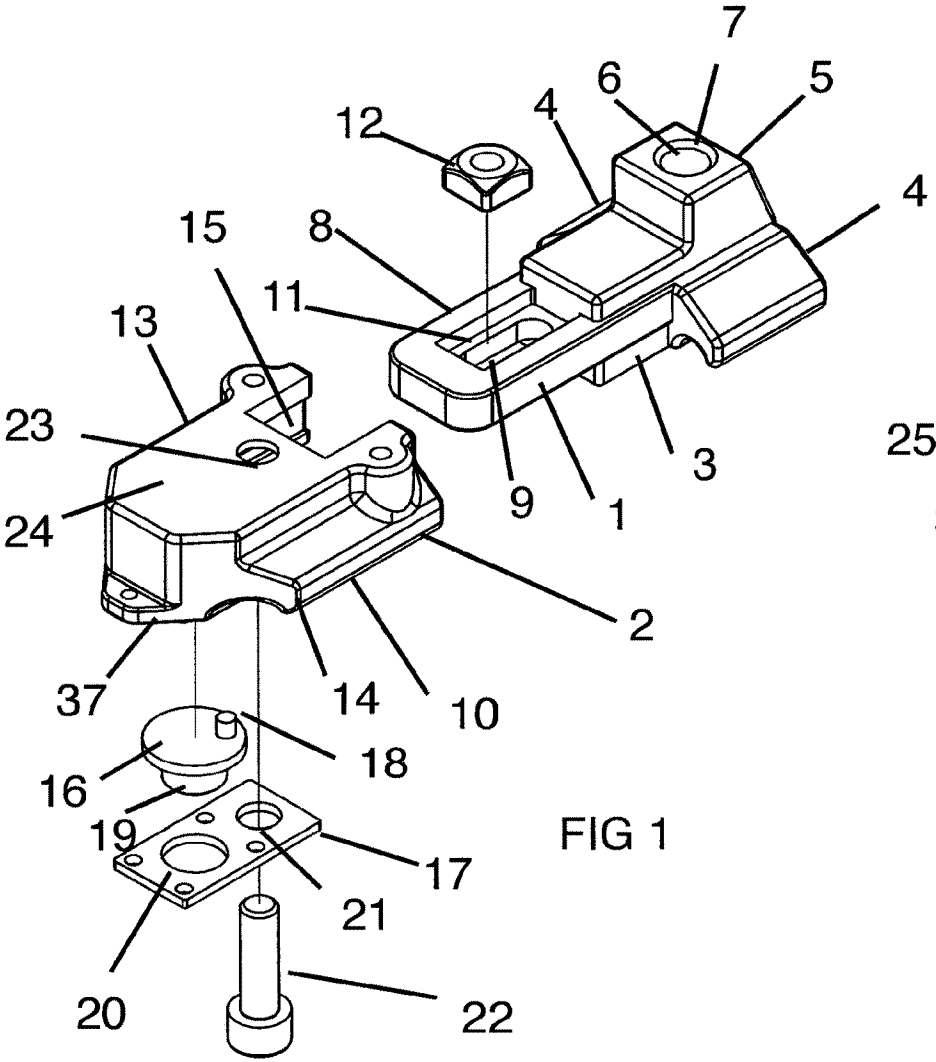
FIG. 1 is an exploded top perspective view of a pivot block.

FIG. 1 shows a pivot block 10 formed of a first part 1 arranged for telescopic movement relative to a second part 2.

The first part 1 has a body 3 with winged side flanges 4 and a raised section 5 with a through passage 6 that has internal threading 7. A slide 8 extends forwardly of the body 3. The slide 8 has a central slot 9, with a rebated shoulder 11 to receive a square lock nut 12.

The second part 2 has a body 13, also with side flanges 14, and a channel 15 to receive the slide 8 of the first part 1. A cam 16 is fitted into a base 37 of the second part 2 and is held in place with a cover plate 17. The cam 16 has an eccentric boss 18 and a shaft 19 that can be accessed through an aperture 20 in the cover plate 17.

The plate 17 also has an opening 21 for a fastener 22 that is arranged to pass through the slide 8, the lock nut 12 and into an aligned opening 23 in a top 24 of the second part 2.

Figure 2:
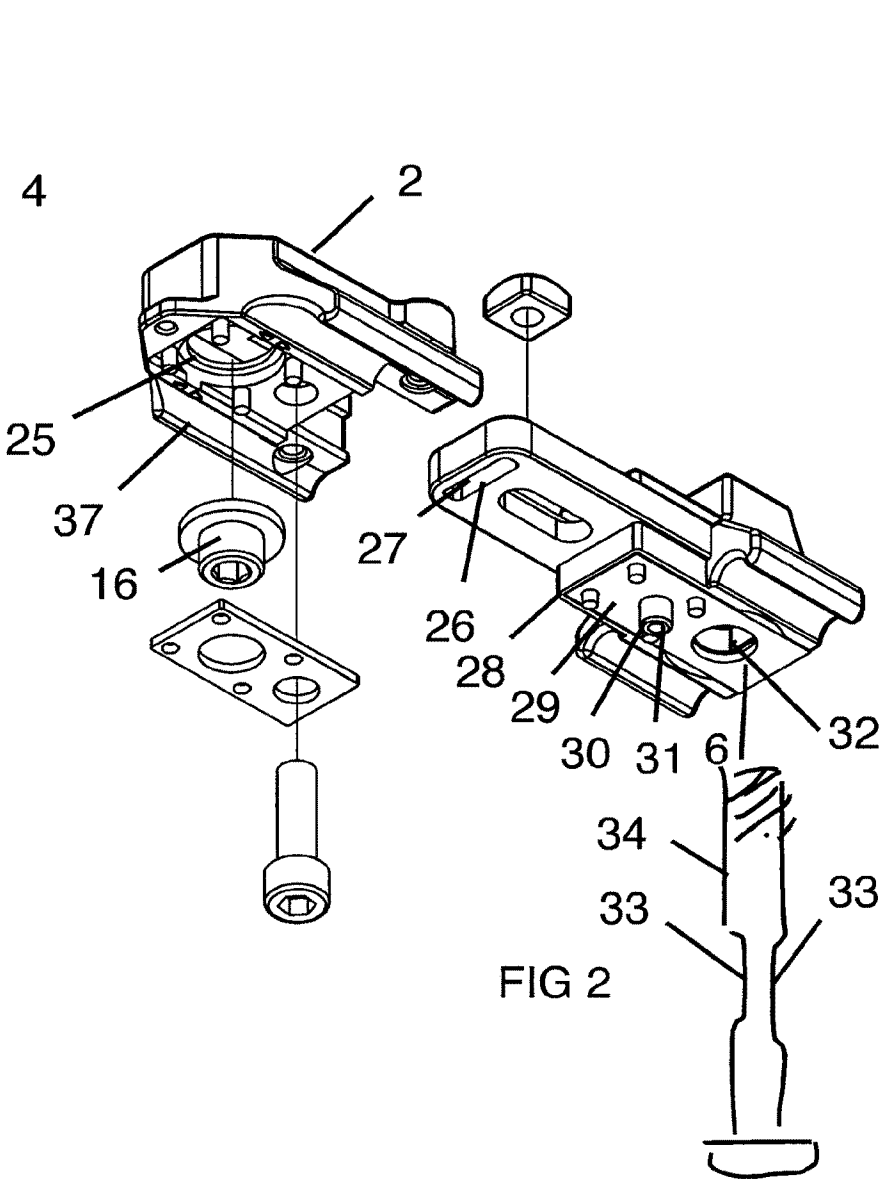
FIG. 2 is an exploded bottom perspective view of the pivot block.

FIG. 2 shows a circular recess 25 in the base 37 of the second part 2, arranged to receive the cam 16. A lateral slot 26 is provided in the first part 1, extending sideward of the slide 8. The slot 26 acts as a follower 27 that is driven by the cam 16.

A base 28 of the first part 1 is also provided with a cover plate 29 that covers a lock mechanism 30 housed within the base 28. The lock mechanism 30 includes a push button actuator 31 that projects through an aperture 32 in the plate 29. The actuator 31 is used to selectively engage a collar 32 that is fitted to flats 33 of a hanger bolt 34 (shown in truncated form for ease of description) introduced into the passage 6. The operation of the lock mechanism 30 is described in more detail later.

Figures 3, 4, 5, 6, 7, 8, 9, 10, 11, 12:
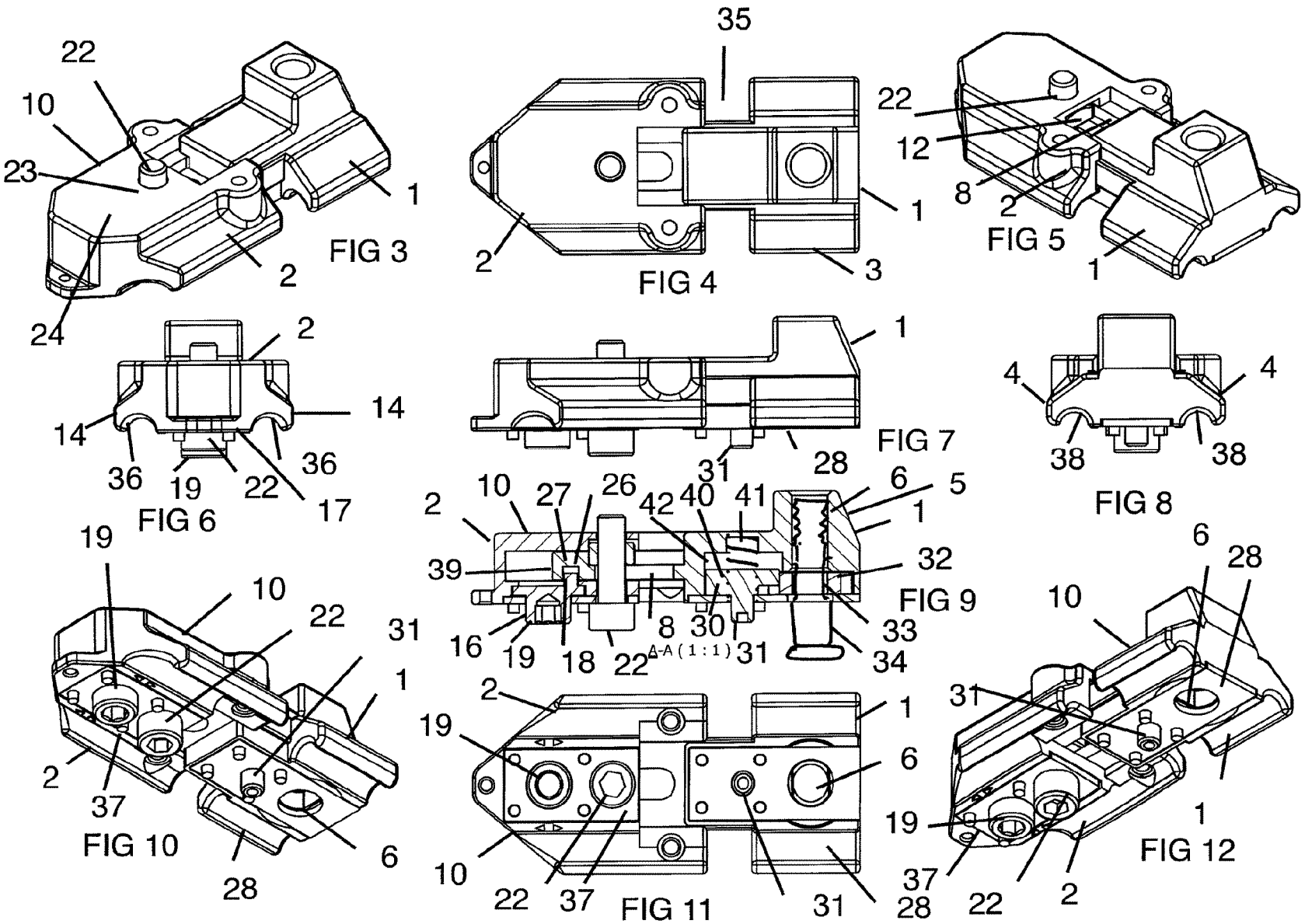
FIG. 3 is a front perspective view of the pivot block.
FIG. 4 is a top view of the pivot block.
FIG. 5 is a rear perspective view of the pivot block.
FIG. 6 is a front view of the pivot block.
FIG. 7 is a side view of the pivot block.
FIG. 8 is a rear view of the pivot block.
FIG. 9 is a cross sectional side view of the pivot block.
FIG. 10 is a bottom front perspective view of the pivot block.
FIG. 11 is a bottom view of the pivot block.
FIG. 12 is bottom rear perspective view of the pivot block.

FIG. 3 shows the first and second parts 1, 2 of the pivot block 10 in an assembled condition where the fastener 22 projects up through the opening 23 in the top 24 of the second part 2.

FIG. 4 shows a gap 35 between the body 3 of the first part 1 and the body 13 of the second part 2, which provides space for the first part 1 to be adjusted closer to the second part 2, if needed.

FIG. 5 shows the lock nut 12 mounted in the slide 8, in alignment with the fastener 22 whereby tensioning of the fastener 22 will cause the lock nut 12 to clamp down onto the slide 8, to fix the position of the first part 1 relative to the second part 2.

FIG. 6 shows the flanges 14 of the second part 2 are formed with curved grips 36 and that the fastener 22 and shaft 19 are accessible from the base 17 of the second part 2.

FIG. 7 also illustrates the actuator 31 as being accessible from a base 28 of the first part 1 and FIG. 8 shows the side flanges 4 are also provided with curved grips 38.

FIG. 9 is a cross section of the pivot block 10, which shows a cam mechanism 39 that includes the cam 16 and the follower 27. To telescopically adjust the first part 1 in and out of the second part 2, the shaft 19 of the cam 16 is rotated, which results in corresponding movement of the boss 18. This in turn causes the boss 18 to track along the lateral slot 26 and force the slide 8 to the left or right, as viewed, which translates into movement of the first part 1. As a result, the position of the bolt 34 mounted in the first part 1 can be adjusted accordingly.

Once the correct position has been obtained, the fastener 22 is used to fix the first and second parts 1, 2 together.

Referring now to the lock mechanism 30, the actuator 31 forms part of a keeper 40 that is recessed into the base 28 of the first part 1, together with the collar 32. The keeper 40 is biased into engagement with the collar 32 by a spring 41 or any other form of suitable biasing means, to prevent rotation of the collar 32. To release the collar 32, the actuator is pressed, to move the keeper 40 out of engagement with the collar 32 and into a receiving space 42.

The collar 32 is fitted onto the flats 33 of the bolt 34 and when the keeper 40 is disengaged, the collar 32 is free to rotate with the bolt 34 to allow for screw threaded height adjustment of the bolt 34 in the passage 6 in the raised section 5. When the actuator 31 is released, the collar 32 is again locked against rotation, in order to also prevent the bolt 34 from rotating, which secures the bolt 34 from unintended height adjustment.

FIGS. 10 to 12 are bottom views of the pivot block 10, where each of the shaft 19, fastener 22, actuator 31 and passage 6 are clearly shown as being accessible, to allow for adjustment and locking of the pivot block 10 through the base 28, 37 of each part 1, 2.

Figure 14:
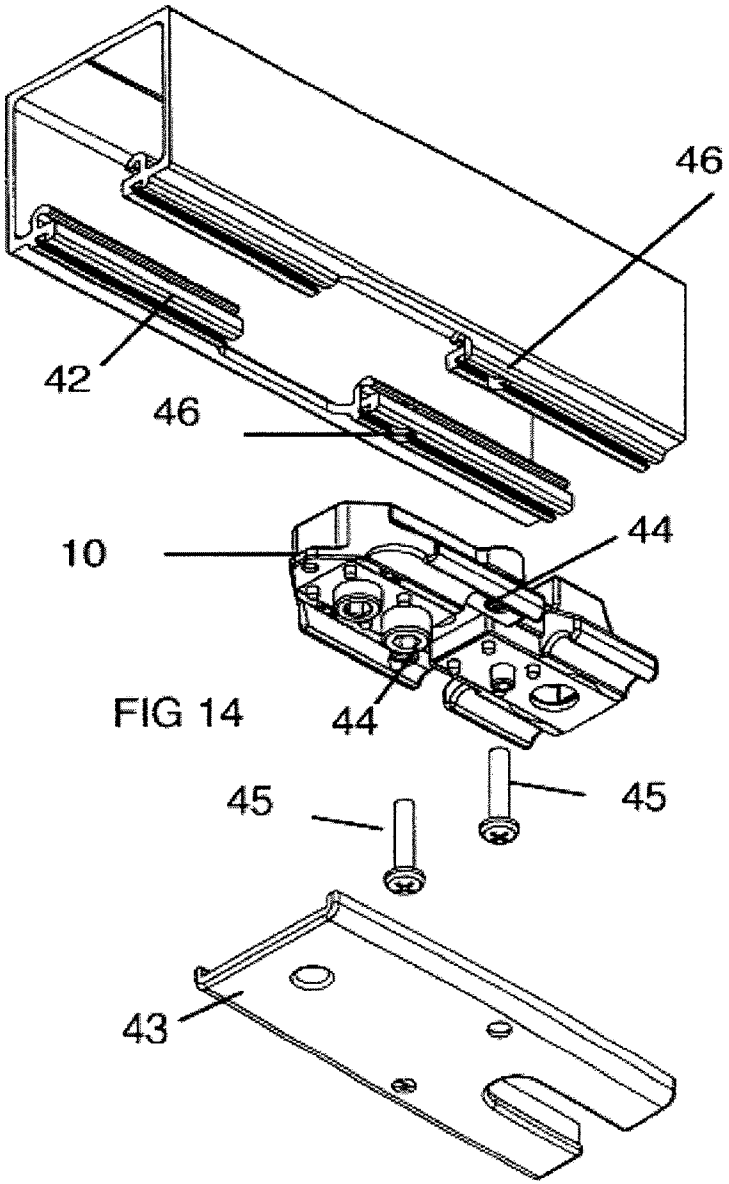
FIG. 14 is a bottom perspective view showing the track, dress plate and pivot block.
Figure 13:
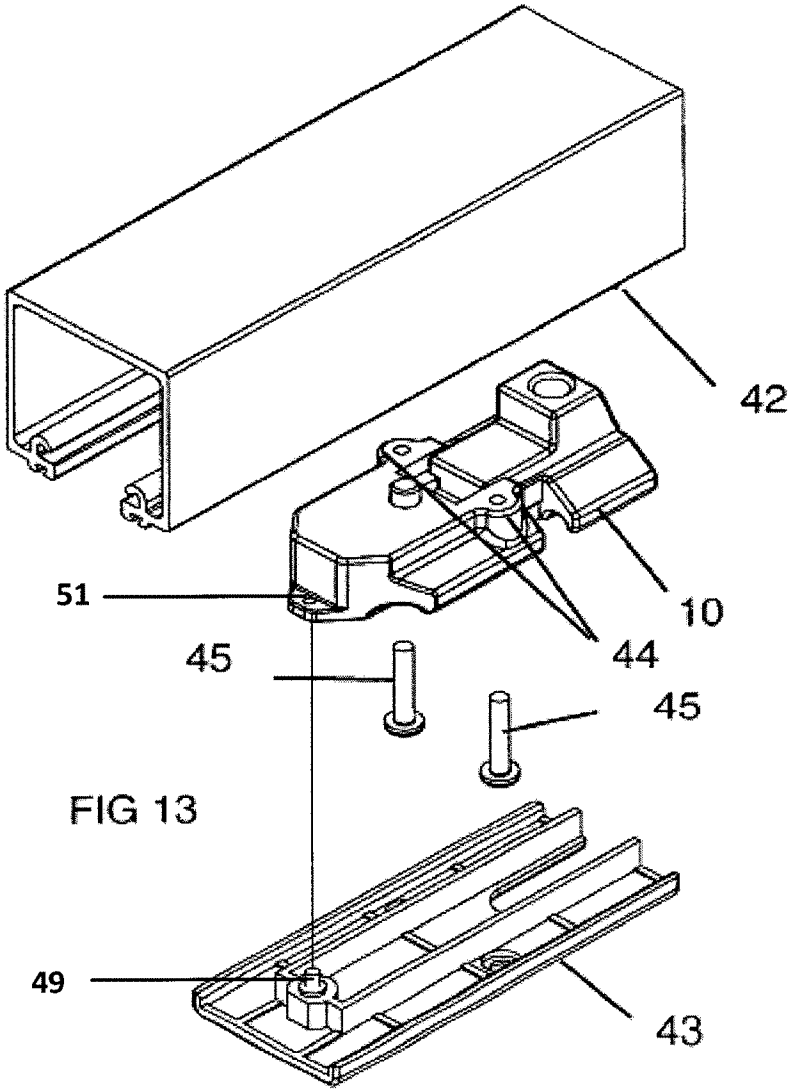
FIG. 13 is a top perspective view showing a track, dress plate and the pivot block.

FIGS. 13 and 14 show a track 42 in which the pivot block 10 is to be mounted, as well as a dress plate 43. The pivot block 10 has two mounting sites 44 that receive connectors 45 to anchor the pivot block 10 though holes 46 in the track 42.

Figure 16:
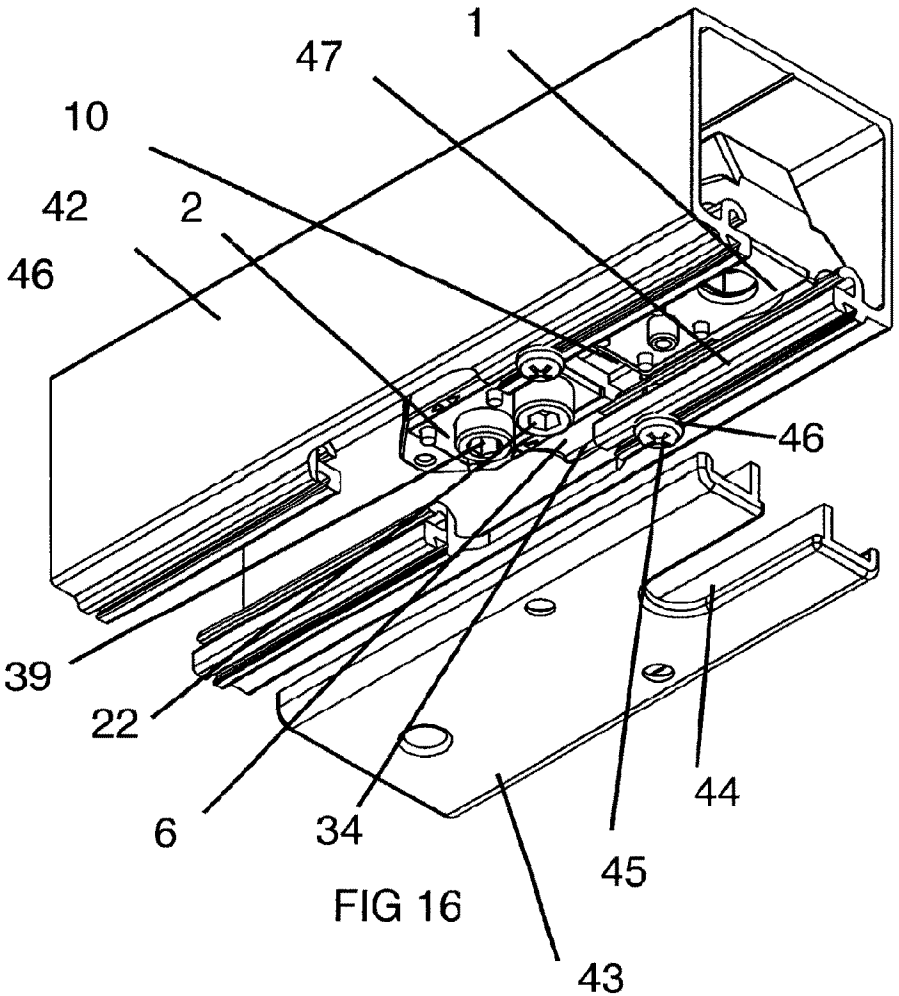
FIG. 16 is a bottom rear perspective view showing the pivot block mounted in the track.
Figure 15:
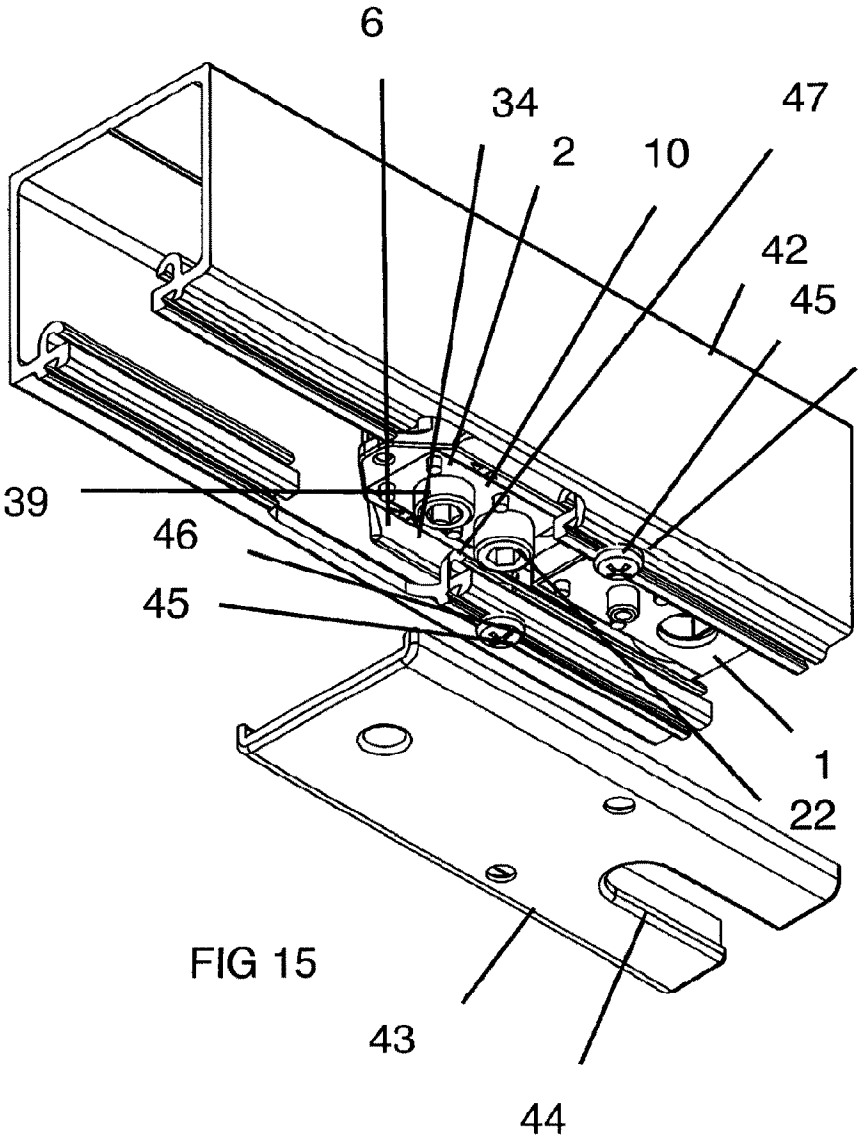
FIG. 15 is a bottom front perspective view showing the pivot block mounted in the track.

FIGS. 15 and 16 show the pivot block 10 installed at an end of the track 42. The connectors 45 are screwed through the holes 46 in the track 42 and into the second part 2 so that the grip 34 of each side flange 6 clamps onto portions 47 of the track 42 with corresponding profiles. The first part 1 can then be adjusted relative to the second part 2, in the manner described above. Once the first part 1 is adjusted accordingly and fixed in place by the fastener 22, the dress plate 43 is simply snap fit onto the track 42 (and/or fixed to first part by fastener) to hide the pivot block 10 from view, in order to provide a neat aesthetic. The dress plate 43 includes an elongate slot 44 that accommodates various positions of the bolt (not shown), resulting from adjustment of the first part 1. If the first part 1 needs to be further adjusted, the dress plate 43 is removed, the fastener 22 released and the cam mechanism 39 engaged to reposition the first part 1 before fixing the position again by engaging the fastener 22.

Figure 17:
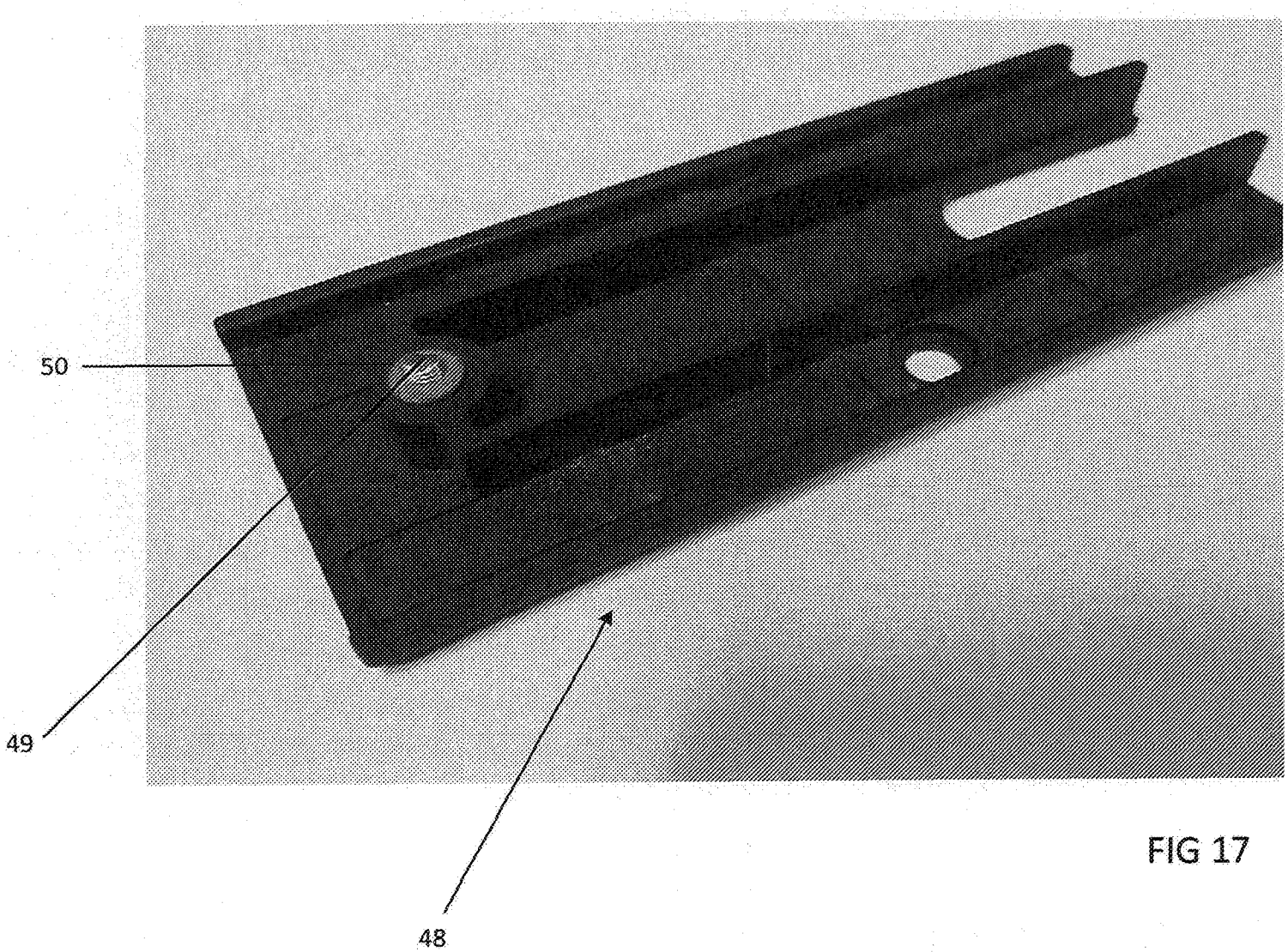
FIG. 17 is a top perspective view of a dress plate.

Lastly, FIG. 17 shows an alternative dress plate 48 that, instead of being snap fit or clipped in place, is attached by a fastener 49 pre-assembled and held in by a fibre washer 50, the fastener 49 being received into a mating hole 51 in the second part 2 of the pivot block 10 (see FIG. 13).

LIST OF PARTS

1. First part
2. Second part
3. Body
4. Side flange
5. Raised section
6. Passage
7. Threading
8. Slide
9. Slot
10. Pivot block
11. Shoulder
12. Lock nut
13. Body
14. Side flange
15. Channel
16. Cam
17. Cover plate
18. Boss
19. Shaft
20. Aperture
21. Opening
22. Fastener

23. Opening
24. Top
25. Recess
26. Lateral slot
27. Follower
28. Base
29. Cover plate
30. Lock mechanism
31. Actuator
32. Collar
33. Flats
34. Bolt
35. Gap
36. Grip
37. Base
38. Grip
39. Cam mechanism
40. Keeper
41. Spring
42. Track
43. Dress plate
44. Mounting sites
45. Connectors
46. Holes
47. Portions
48. Alternative Dress Plate
49. Fastener
50. Washer
51. Mating Hole

The invention claimed is:

1. A device, comprising a first part comprising a passage that is configured to hold a bolt of an associated folding panel, and the device also comprising a second part that has side flanges configured to be fixed to a track so as to position the first part and the passage at a location along the track, wherein the first part is slidably connected to the second part so that the first part can slide relative to the second part in a direction lengthwise of the track, wherein the first part defines a first end of the device and the second part defines a second end of the device so that the sliding relative movement of the two parts changes an overall length of the device, wherein one of the parts has a slide that moves along a channel formed in the other one of the parts when the parts are moved to adjust the overall length of the device, the sliding relative movement being between a shortened position where the slide is substantially in the channel and a lengthened position where the slide extends partially out of an end of the channel, the device further comprising a fastener to secure the first and second parts together and a mechanism that operates between the first and second parts to drive the movement of the first part relative to the second part, wherein the mechanism comprises a cam mounted to one of the parts and a follower provided in the other part, the cam having a shaft that can be accessed through a base of one of the parts and an eccentric boss associated with the shaft that is in contact with the follower to move the other part when the shaft is rotated.

2. The device of claim 1, wherein the follower is a lateral groove in the other part, the lateral groove extending within a plane that is perpendicular to a rotational axis of the shaft.

3. The device of claim 1, wherein the fastener passes through the slide and into a lock nut that clamps against the slide and fixes the parts together.

4. The device of claim 1, wherein the device comprises one or more connectors that pass through the second part to lock the side flanges to the track.

5. The device of claim 1, wherein the first part comprises a thread in the passage for screw-threaded engagement of the bolt, and a lock mechanism that comprises a collar that registers with flats of the bolt, and a keeper for selectively holding the collar against rotation, thereby securing the bolt against rotation and height adjustment.

6. The device of claim 5, wherein the keeper is biased into engagement with the collar.

7. The device of claim 6, wherein the keeper comprises a push button actuator that when pressed moves the keeper against the bias and out of engagement with the collar, to thereby accommodate rotation of the bolt for height adjustment.

8. The device of claim 7, wherein the first part has a recess to house the keeper and the collar, and the first part also having a cover plate fitted over the recess, wherein the cover plate comprises openings for the push button and for receipt of the bolt.

9. The device of claim 8, wherein a cover plate is also fitted over a recess of the second part, the cover plate fitted to the second part having apertures for the cam mechanism and fastener.

10. The device of claim 1, further comprising an associated dress plate removably connected to the device, the dress plate serving to hide the device from view when mounted onto the track, the dress plate comprising an elongate slot to accommodate various positions of the bolt, resulting from adjustment of the first part.

11. The device of claim 1, in combination with a bolt mounted in the first part of the device.

* * * * *